US005090300A

United States Patent [19]

Berenstein

[11] Patent Number: 5,090,300

[45] Date of Patent: Feb. 25, 1992

[54] PLEASURE MIRROR AND FAN UNIT

[76] Inventor: Eugenia Berenstein, 1913 E. 24th St., Brooklyn, N.Y. 11229

[21] Appl. No.: 643,516

[22] Filed: Jan. 22, 1991

Related U.S. Application Data

[63] Continuation-in-part of Ser. No. 437,395, Nov. 16, 1989, abandoned.

[51] Int. Cl.[5] ..... F24F 13/00

[52] U.S. Cl. ..... 454/370; 359/838

[58] Field of Search ..... 98/1; 350/600, 584; 415/121.3

[56] References Cited

U.S. PATENT DOCUMENTS

| | | | |
|---|---|---|---|
| 2,123,071 | 7/1938 | Ballman | 98/1 X |
| 2,123,448 | 7/1938 | Weber | 98/1 X |
| 2,826,758 | 3/1958 | Kahn | 98/1 X |
| 3,096,702 | 7/1963 | Malone, Sr. et al. | 98/1 |
| 4,037,079 | 7/1977 | Armbruster | 350/584 X |
| 4,439,013 | 3/1984 | Hagn et al. | 350/584 X |

*Primary Examiner*—William E. Tapolcai
*Attorney, Agent, or Firm*—Martin Smolowitz

[57] ABSTRACT

A pleasure mirror and fan unit includes a mirror mounted in a frame and a fan together with a lamp in a common unit. The mirror may be of any size or profile, e.g. oval, round or rectangular shaped. The fan may be pivotably mounted on the top or on either side of the mirror frame, and has variable speed operation for directing a low velocity of air against the face of a user. The mirror-fan unit is preferably portable, but may also be provided as a cabinet mirror and is useful for make-up or shaving purposes.

13 Claims, 1 Drawing Sheet

PLEASURE MIRROR AND FAN UNIT

This is a continuation-in-part application of Ser. No. 07/437,395 filed Nov. 16, 1989, abandoned.

BACKGROUND OF INVENTION

The present invention relates to a mirror and fan unit, which can be either free-standing portable or wall mounted type, and adapted to direct a low velocity flow of air against the face of a user.

Various mirror arrangements have been provided for use in hairdressing, make-up, and shaving purposes, and some are provided with either lamp or fan units. Examples of such units are disclosed by U.S. Pat. No. 2,123,071 to Ballman; U.S. Pat. No. 4,037,079 to Armbruster, U.S. Pat. No. 4,439,013 to Hagen et al, and U.S. Pat. No. 4,752,863. However, such prior units have various limitations and do not provide desired convenience and flexibility for a combined mirror and fan unit which can be made portable and self-contained. These disadvantages have now been advantageously overcome by the present invention.

SUMMARY OF INVENTION

It is a primary object of this invention to provide a mirror and fan unit which can utilizes either a portable or wall mounted mirror. It is another object of the invention to provide a compact unit which is easy to operate and can provide an air flow to a user's face located in front of the mirror for personal tasks, i.e. applying make-up or shaving. Another object of the invention is to provide a unit having a fan which is either separate or integral with a mirrored medicine cabinet provided in a bathroom or dressing area. Still another object of the invention is to provide a unit having a battery operated fan and which is convenient for use in traveling.

The present invention provides a mirror and fan combination unit for convenient use by a person sitting or standing in front of the unit. The unit includes a rigid frame, a mirror mounted in the frame, and at least one lamp located on either side of the mirror. A fan which is preferably variable speed is adjustably mounted onto the frame above the mirror, and is directed generally forwardly so as to provide a flow of low velocity air against the face of a user located in front of the mirror. The lamp(s) are electrically powered and are either fluorescent or incadescent type, and are powered either from a 110–115 or 220 volt A.C. electric power source, or from a battery pack located in the mirror frame. Operation of the lamp(s) and fan are separately controlled by switches located in the mirror frame. The air velocity produced by the fan should be within a range of 0.5–2 ft/sec., and is preferably 0.8–1.5 ft/sec. The mirror can have an oval, round, or rectangular shape, and can be pivotably mounted in the frame. The frame is made of a rigid relatively light weight material, including metals such as aluminum, bronze, or stainless steel, or rigid plastic material such as polyvinylchloride or polystyrene. The mirror consists of reflective backed transparent glass or plastic material.

It is an advantage of my invention to provide a mirror and fan unit which has a low velocity air flow which is pleasurable to the face, when a user is sitting in front of a lighted mirror that radiates heat, and also for a person sitting in a room which is not cooled by air conditioning. The mirror and fan unit embodiments are particularly for home, travel or theatrical make-up applications.

The scope of the present invention will become apparent from the detailed description and claims given hereinafter. However, it will be understood that the detailed description and specific example, while indicating preferred embodiments of the invention, are given by way of illustration only, and various modifications and variations within the spirit and scope of the invention will become apparent from this description to those skilled in the art.

BRIEF DESCRIPTION OF DRAWINGS

The present invention will be better understood from the accompanying drawings and the description which are provided by way of illustration only, and are not limitative of the invention, and wherein.

DESCRIPTION OF INVENTION

Figure 1:
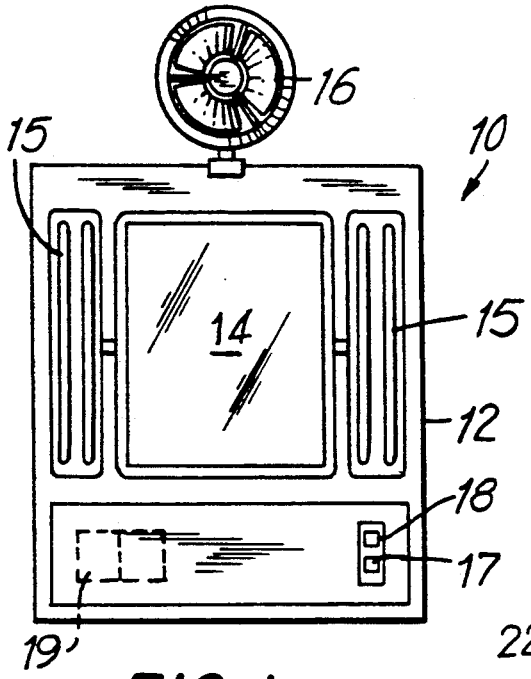
FIG. 1 is a perspective elevation view of a combined mirror and fan unit according to the invention.

As shown by the drawings, the FIG. 1 preferred embodiment of the invention is a free standing mirror and fan unit 10, which includes a rectangular shaped frame 12 having a mirror 14 rigidly mounted on the frame front side. An elongated electrical lamp 15 is mounted vertically along at least one and preferably each side of the mirror 14 so as to illuminate the mirror. A fan 16 is centrally and adjustably mounted above the mirror 14, and is adapted to provide a low velocity flow of air forwardly, which air flow can be directed generally against the face of a user of the mirror-fan unit 10. The fan is preferably multi-speed type having 3–5 speeds, and is 5–7 inches in diameter. The lamps 15 are controlled by an electrical switch 17, and the fan 16 operation is controlled by a switch 18 which are each conveniently located in the frame 12 below the mirror 14. The lamp 15 and fan 16 are operated either from a 110 volt A.C. power source through a conventional electrical cord (not shown), or are operated from a battery pack 19 provided within the lower portion of frame 12. The battery pack 19 is preferably rechargeable and replaceable. Alternately, the lamps 15 and fan 16 can be operated from a 220 volt A.C. power source through a step-down voltage transformer **19*a* which is connected to electrical switch 18*a* located in the lower portion of frame 12**.

Figure 2:
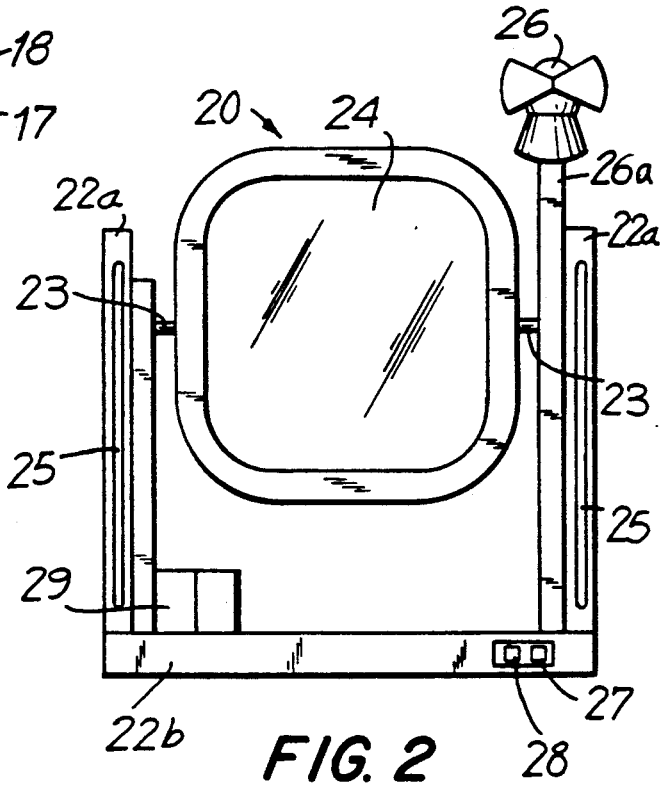
FIG. 2 is a front elevation view of an alternative combined mirror and fan unit having a different configuration and profile.

FIG. 2 shows an alternative mirror and fan unit configuration or embodiment 20, which has a frame 22 formed by dual upright members **22*a* and a base member 22*b*. A mirror 24 is pivotally mounted between the dual upright members 22*a* by dual pivots 23, so that the mirror can be adjusted to any angle as desired by the user. An elongated electrical lamp 25 is provided in each upright member 22*a* and adapted for illuminating the mirror 24. A multi-speed fan 26 is provided removably attached to an upper extension 26*a* of either one of the uprights 22*a*. A switch 27 is provided in base member 22*b* for operating the lamps 25, and a switch 28 is similarly located for operating fan 26. The lamps and fan can be operated either from a 110 volt A.C. power source through a conventional electrical cord (not shown), from a battery pack 29 which is preferably rechargeable and located within lower frame member 22b, or from a 220 volt A.C. power source utilizing a transformer and a separate switch similarly as for FIG. 1. Alternatively, a separate removable fan unit 26a and rechargeable battery pack 29a is provided which can be removably attached to upright member 22a**, for more convenient use of the mirror and fan unit during traveling.

Figure 3:
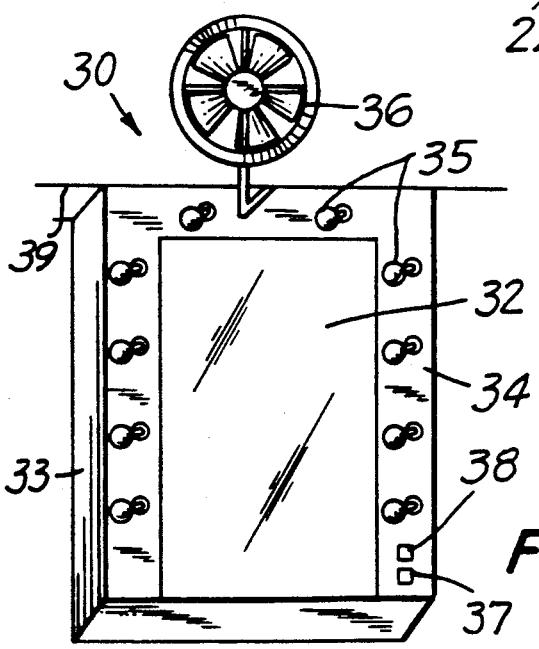
FIG. 3 is a perspective view of a wall mounted mirror and fan unit having a fan adjustably located above the mirror.

FIG. 3 shows another alternative configuration for a mirror and fan combination unit 30. In this embodiment, a mirror 32 having a surrounding frame 34 is mounted vertically on or within wall 39. A plurality of individual lamps 35 are provided located on either side and above the mirror 32. Preferably, four lamps 35 are located on each side of the mirror 32 and two lamps 35 are located above the mirror. A fan 36 is centrally and adjustably mounted above the mirror 32 and lamps 35, and is directed generally outwardly so as to provide a stream of low velocity air generally against the face of a user of the mirror-fan unit 30. The lamps 35 are operated by an electrical switch 37, and fan 36 is operated by electrical switch 38 located in the lower portion of frame 34. Electrical power is provided to the switches from a 110 volt A.C. source (not shown). Also if desired, the mirror 32 can be mounted on dual hinges 32a located along one of its vertical sides, so as to provide an openable door enclosing a cabinet 33 used for storage of make-up materials and such. For the mirror and fan unit 10, 20 or 30, the mirror 14, 24, or 32 for each embodiment should be at least 7 inches in diameter, or 7 inches square, and it should not exceed a maximum size of 15 inches diameter, or 24 inches height by 18 inches width. The preferred mirror size is 10–13 inches height by 9–11 inches width. The frame element is made of a rigid lightweight material such as aluminum or polyvinylchloride (PVC). The air velocity emitted from fan 16, 26 or 36 should be sufficient to produce a pleasant sensation on the face of a user, such as 0.8–1.5 ft./sec. air velocity. For mirrors having a height exceeding 24 inches, the fan can be arranged to oscillate horizontally, or dual separated fans can be advantageously provided.

The pleasure mirror and fan unit according to this invention will be further described by an Example, which should not be construed as limiting in scope.

EXAMPLE

A mirror and fan unit is constructed similarly as depicted in FIG. 1, and includes a rectangular-shaped frame formed of molded rigid plastic polyvinylchloride (PVC) material, with a glass mirror being retained in grooves in the frame. An elongated fluorescent bulb is mounted in the frame along each side of the mirror, and a multi-speed fan is centrally mounted onto the upper surface of the frame. Electric power is provided to the bulbs and fan from a rechargeable battery pack located in the lower portion of the frame below the mirror. The lamps and fan are each electrically connected to a switch located on the front side of the lower portion of the frame.

Some important dimensional and operational characteristics of this frame and mirror unit are as follows:

| | |
|---|---|
| Frame height and width, in. | 13 × 11 |

-continued

| | |
|---|---|
| Mirror height and width, in. | 8 × 6 |
| Frame depth, in. | 1.5 |
| Fan blade diameter, in. | 4 |
| Air velocity from fan, ft/sec. | 1.0 |

The invention being thus described, it will be obvious that it may be modified and varied in many ways. Such modifications are not to be regarded as a departure from the spirit and scope of the invention, and all such variations which would be obvious to one skilled in the art are intended to be included within the scope of the following claims.

What is claimed is:

1. A pleasure mirror and fan unit, comprising: a frame, a mirror mounted in the frame, at least one electric lamp attached to the frame adjacent the mirror so as to illuminate the mirror; and an electric-powered fan mounted onto the frame adjacent the upper portion of the mirror, said fan being activated from a switch located on the mirror frame and directed generally forwardly from the mirror so as to provide a low velocity air flow against the face of a user.

2. A mirror and fan unit according to claim 1, wherein said mirror is pivotably mounted in said frame.

3. A mirror and fan unit according to claim 1, wherein said fan is mounted onto the top of the mirror frame above the mirror.

4. A mirror and fan unit according to claim 1, wherein the electric lamp and fan are each battery powered and the unit is portable.

5. A mirror and fan unit according to claim 4, wherein the battery is a rechargeable type battery.

6. A mirror and fan unit according to claim 1, wherein the fan is pivotably attached to the frame upright members.

7. A mirror and fan unit according to claim 1, wherein the fan has 3–5 operating speeds.

8. A mirror and fan unit according to claim 1, wherein the mirror is a wall mounted cabinet, and said fan is mounted on an extended bracket above the mirror.

9. A mirror and fan unit according to claim 1, wherein said frame is made of a rigid plastic material.

10. A mirror and fan unit according to claim 1, wherein the air flow velocity from the fan is 0.5–2 ft./sec.

11. A portable pleasure mirror and fan unit, comprising:

a rigid rectangular-shaped frame;

a mirror mounted in said frame;

dual electric lamps mounted in said frame adjacent said mirror, so as to illuminate the mirror; and an electric-powered multi-speed fan mounted onto an upper portion of said frame, said fan being directed generally forwardly from the mirror and activated by a switch located on the mirror frame so as to provide a low velocity air flow against the face of a user.

12. A mirror and fan unit according to claim 1, wherein said frame contains an 220 volt/110 volt electric transformer and switch, so as to permit operation of the lamp and fan on a 220 volt A.C. power source.

13. A mirror and fan unit according to claim 4, wherein said fan and battery pack are removably attached to said frame member.

* * * * *